US009822527B1

(12) United States Patent
Ruga et al.

(10) Patent No.: US 9,822,527 B1
(45) Date of Patent: Nov. 21, 2017

(54) PREFABRICATED CONCRETE FLOOR STRUCTURE

(71) Applicant: Northeast Precast Limited Liability Company, Millvale, NJ (US)

(72) Inventors: John Ruga, Vineland, NJ (US); Kenneth Baur, Mohnton, PA (US); Peter John Gorgas, Vineland, NJ (US)

(73) Assignee: Northeast Precast Limited Liability Company, Millville, NJ (US)

( * ) Notice: Subject to any disclaimer, the term of this patent is extended or adjusted under 35 U.S.C. 154(b) by 0 days.

(21) Appl. No.: 15/380,555

(22) Filed: Dec. 15, 2016

(51) Int. Cl.

| | |
|---|---|
| ***E04C 1/00*** | (2006.01) |
| ***E04B 5/04*** | (2006.01) |
| ***E04B 5/26*** | (2006.01) |
| ***E04B 1/84*** | (2006.01) |
| ***E04G 11/36*** | (2006.01) |
| ***B28B 1/14*** | (2006.01) |
| ***B28B 7/26*** | (2006.01) |
| *E04B 5/17* | (2006.01) |

(52) U.S. Cl.
CPC ..... *E04B 5/046* (2013.01); *B28B 1/14* (2013.01); *B28B 7/26* (2013.01); *E04B 1/84* (2013.01); *E04B 5/266* (2013.01); *E04G 11/36* (2013.01); *E04B 2005/173* (2013.01); *E04B 2103/02* (2013.01)

(58) Field of Classification Search
CPC ... B28B 1/14; B28B 7/26; E04B 5/046; E04B 1/84; E04B 5/266; E04B 2005/173; E04C 2/288; E04G 11/36
See application file for complete search history.

(56) References Cited

U.S. PATENT DOCUMENTS

| | | | | | |
|---|---|---|---|---|---|
| 2,140,226 | A * | 12/1938 | Harrap | E04B 1/84 | 52/403.1 |
| 4,205,029 | A * | 5/1980 | Forrest | B28B 23/046 | 264/228 |
| 5,943,775 | A * | 8/1999 | Lanahan | B26D 1/553 | 264/142 |
| 6,272,749 | B1 * | 8/2001 | Boeshart | E04B 5/36 | 29/897.32 |
| 6,817,150 | B1 * | 11/2004 | Boeshart | B28B 7/0082 | 249/102 |
| 8,627,616 | B2 * | 1/2014 | Caboni | E04B 5/19 | 52/173.1 |
| 8,734,691 | B1 * | 5/2014 | Boeshart | E04B 5/19 | 264/333 |
| 8,844,227 | B1 * | 9/2014 | Ciuperca | E04C 2/296 | 52/309.11 |
| 2005/0086904 | A1 * | 4/2005 | Foley | B28B 19/003 | 52/782.1 |

* cited by examiner

*Primary Examiner* — Brian D Mattei
(74) *Attorney, Agent, or Firm* — Hooker & Habib, P.C.

(57) ABSTRACT

A precast concrete floor panel having stems molded in a mold with stem mold cavities and a deck. The deck can be formed in the same mold that includes the stem mold cavities or the concrete for the deck can be poured and cured on-site after the stems have been removed from the mold. The mold can include mold segments made from an insulating material that can remain attached to the stems to insulate the finished floor panel.

7 Claims, 15 Drawing Sheets

PREFABRICATED CONCRETE FLOOR STRUCTURE

FIELD OF THE DISCLOSURE

The disclosure relates generally to building construction, and more specifically, to construction of precast or partially precast concrete floors.

BACKGROUND OF THE DISCLOSURE

FIGS. 14-16 illustrate a conventional precast floor panel 210 for use as all or part of a building floor. The precast floor panel 210 includes a monolithic concrete slab 212 that is poured and cured in a mold 214. The mold 214 is formed from flat sheets of expanded polystyrene foam that will remain attached to the cured concrete, and from mold parts that define exposed outer surfaces that will be removed from the concrete after curing. The mold parts removed after curing may be made of plywood, timber, foam sheets, or other suitable material.

The foam sheets that remain attached to the concrete provide insulation (thermal resistance) and reduce noise transmittal in the finished floor panel 210. A number of floor panels 210 can be connected side-by-side and/or end-to-end in a conventional manner for constructing a larger building floor.

The concrete slab 212 is generally rectangular-shaped and includes a reinforced top sheet or deck 224 that defines a flat floor extending the width and length of the floor panel 210. A number of parallel, spaced apart stems 226 are also formed integral with the deck 224 on the bottom side of the deck 224. The stems 226 extend along the length of the floor panel 210 and connect together a pair of end blocks 228, 230.

The end blocks 228, 230 on the bottom of the deck 224 are adjacent the ends of the deck 224 and extend the width of the floor panel 210. The blocks 228, 230 each extend about the same height as the total height of a stem 226 plus the thickness of the foam sheet on the bottom of the stem, and are each typically between two inches and three inches wide.

The blocks 228, 230 resist longitudinal cracking of the deck. The blocks 228, 230 allow floor panels 210 to be set between wall members to allow stacking of floor panels 210 for multi-story construction and can act as beams to span gaps if the wall members cannot provide continuous support of the blocks. The blocks 228, 230 also allow stacking of floor panels 210 during storage and transport.

The illustrated deck 224 typically has a thickness of between one inch and one-and-one-quarter inches, and a length of between eight feet and fifty feet. The concrete forming the deck 224 can be reinforced with reinforcement bars, reinforcement wires, wire mesh, fibers, or the like embedded in the soft concrete or mixed into the concrete prior to pouring as is known in the concrete construction art. An optional light-weight, non-structural leveling coat can be applied to the top of the deck 224.

The stems 226 extend away from the bottom deck surface 234 and extend the span of the slab 212 between the end blocks 228, 230. The illustrated stems 226 are spaced apart from one another on two-foot centers, each stem 226 having a generally rectangular cross-section as viewed in FIG. 11 with a preferred width of between two inches and fifteen inches. The stems 226 extend from the surface 234 a preferred distance of between six inches and sixteen inches.

A stem 226 is pre-stressed by strands 240, 242 extending the length of the stem 226. In shorter stems, reinforcing bars or rods can be used instead for pre-stressing or reinforcing the stems.

The insulation mold 214 is constructed from flat foam sheets that are trimmed to the required length and width and assembled together to form the mold. The flat sides of the sheets automatically form smooth surfaces that define the facing smooth surfaces of the floor panel 210. The thickness of the sheet essentially defines the thickness of the insulation insulating the slab at the sheet's location in the mold 214.

The mold 214 includes generally U-shaped mold cavities that define the stems 226 and flat decking sheets 244 between the mold cavities that define the bottom of the deck. Each mold cavity is made of two sheet segments 246 that form the leg of the "U" and a sheet segment joining the legs 246. The decking sheets 244 are trimmed to the appropriate length and width from two-inch thick foam sheets. The "U" sheet segments are each trimmed to the appropriate length and width from one-and-one-eighth-inch thick foam sheets.

Joints join the decking sheets 244 and the leg sheets 246 to form the mold transitions from the stems to the deck. In the illustrated embodiment the joints are rabbet joints, with the leg sheets 246 received in rabbet grooves in the decking sheets 244. The joints define generally planar seams between facing surfaces of the sheets 244, 246 that extend along the length of the stems.

A metal or wood wall stud 248 is attached to the bottom side of each "U" mold segment which can be used for attachment of drywall or other finishing materials to the finished floor. The stud 248 can be provided with protrusions that extend into the mold cavity of the mold 214 that enable the stud 248 to be rigidly held in the set concrete forming the stem 226. A tube or shaft can be placed in the stem portion of the mold 214 to form an optional through-passage 250 (shown in phantom in FIG. 10) for passing wires, cabling, bolts, or the like through the stem 226. Wire mesh or the like (not shown) may also be placed in each stem mold portion prior to the concrete pour, the mesh extending the full or partial length of the stem 226 to resist shear forces.

Precast floor panels 210 have proven to be cost effective and are well-received as an alternative to cast-in-place concrete floors. Nevertheless, there is room for improvement. Furthermore, a truck can only deliver a limited number of floor panels 210 to a job site due to the size and weight of the floor panels 210.

SUMMARY OF THE DISCLOSURE

Disclosed is an improved method for forming a precast or partially precast floor panel in which concrete is poured into a mold formed at least in part by mold segments cut from pre-manufactured blocks of form insulation. The pre-cut mold segments eliminate the seams found in conventional joint construction.

EPS foam insulation is commercially available in block form rather than sheet form. A typical commercially available block of EPS foam insulation has a rectangular cross section of three feet by between four feet and eight feet, and lengths of eight feet, eight-and-one-half feet, and nine feet.

The mold is formed by assembling mold segments, including stem mold segments that cooperate to define stems and the floor of the deck between stems. The stem mold segments are made by cutting the required shape of the mold stem segment from the foam block. By cutting the mold segment from a block the thickness of the mold segment is not limited to the thickness of a flat sheet.

The stem mold segments are integral, one-piece members and so do not have joints or seams that extend along the length of the stems that might fail during the concrete pour when mold segments are formed from multiple sheet members.

In an embodiment, stem mold segments are spaced apart from one another to partly define mold cavities between adjacent stem mold segments for the stems. The sides of each mold cavity is defined by the sides of the adjacent stem mold segments. The bottom of the mold cavity extending between the adjacent stem mold segments is closed by a closing member. In an embodiment the closing member is a plywood sheet.

Stem mold segments that are adjacent the sides of the mold and form a side of only one mold cavity are essentially cut-off versions of the stem mold segments that are placed between adjacent pairs of mold cavities.

In another embodiment the mold segments defining each of the outer stems not disposed between another pair of stems define a support flange having a reduced thickness, the support flange extending from a respective outer longitudinal edge of the panel towards the interior of the panel. The deck can be formed on-site by pouring a concrete deck over the stems and the pair of support flanges.

In an embodiment the shape of the stem mold segments facilitates nesting or interlocking of the stem mold segments cut from the foam block, thereby reducing labor costs and waste.

In an embodiment of the method the mold is initially filled with concrete to form and cure only the stems and end blocks and not the deck. The mold with the cured stems and end blocks are transported to the job site and concrete is poured into the mold to form the deck on-site. By only forming the stems and end blocks off-site, the reduction in weight as compared to a fully pre-cast slab enables a truck to transport more of the partially completed floors to the job site.

In an alternative embodiment, a precast floor panel is cast in a steel mold that defines a flange or deck and stems of a monolithic concrete slab. The slab does not include end blocks; the stems run the full length of the deck. If desired, the slab can be delivered to a job site or used without insulation attached to the slab.

Other objects and features of the disclosure will become apparent as the description proceeds, especially when taken in conjunction with the accompanying drawing sheets illustrating one or more illustrative embodiments.

DETAILED DESCRIPTION

Figure 1:
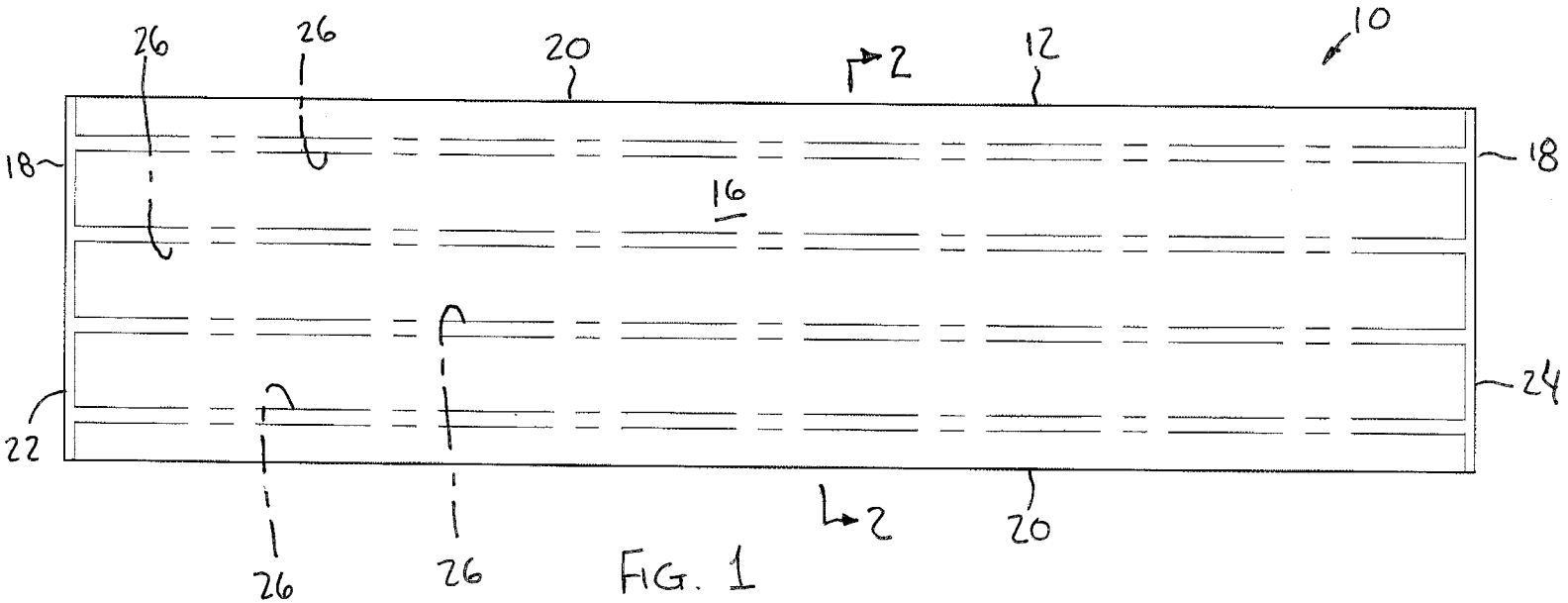
FIG. 1 is a plan view of the top of a precast concrete floor intended to be manufactured off-site.
Figure 2:
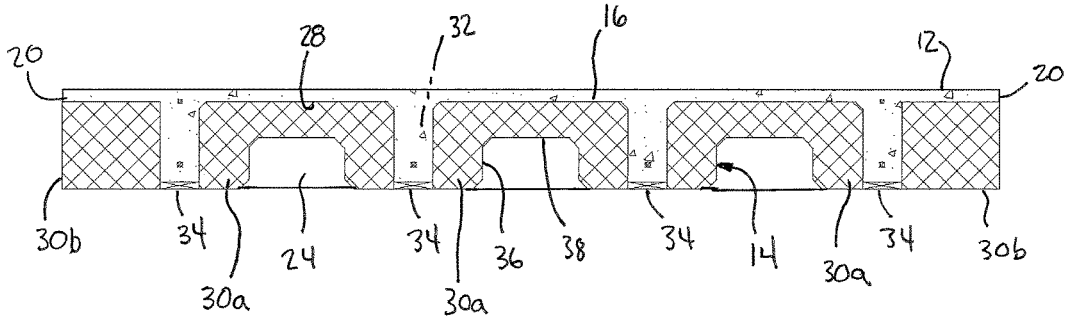
FIG. 2 is a cross-sectional view of the floor shown in FIG. 1 taken along line 2-2 of FIG. 1.

FIGS. 1 and 2 illustrate a precast concrete floor panel 10. The precast floor panel 10 includes a monolithic concrete slab 12 that was poured and cured in a mold 14 formed in part from mold segments described below. The mold segments are cut from EPS (expanded polystyrene) foam blocks. The foam block mold segments remain attached to the concrete slab 12 after the slab 12 has solidified in the mold.

The concrete slab 12 is generally rectangular-shaped and includes a reinforced top flange or deck 16 that defines a flat floor extending the width and length of the floor panel 10 along lateral sides 18 and longitudinal sides 20. End blocks 22, 24 on the bottom of the deck 16 extend the width of the floor panel 10. Four parallel, spaced-apart stems 26 are also on the bottom of the deck 16 and extend along the length of the floor panel 10, connecting together the end blocks 22, 24. The outermost stems 26 are spaced inwardly from the sides 20 of the deck 16.

The illustrated deck 16 has a thickness of one inch. The concrete forming the deck, blocks and stems can be reinforced or pre-stressed with reinforcement bars, reinforcement wires, wire mesh, fibers, or the like (not shown) embedded in the soft concrete or mixed into the concrete prior to pouring as is known in the concrete construction art. An optional light-weight, non-structural leveling coat can be applied to the top of the deck 16.

The stems 26 extend away from the bottom deck surface 28 and extend along the span of the slab 12. The illustrated stems 26 extend along respective longitudinal axes and are spaced apart laterally from one another on two-foot centers, each stem 26 having a preferred width of between two inches and fifteen inches, and extend from the deck bottom surface 28 a distance of between six inches and sixteen inches.

The insulation mold 14 is constructed in part from a number of stem mold segments 30 realized as like stem mold segments 30*a* and like stem mold segments 30*b*. The stem mold segments 30 are arranged to extend along respective longitudinal axes parallel with the stem axes and are also arranged to be spaced apart laterally. The stem mold segments 30 are sandwiched between the end blocks and extend the full length of the stems 26, and are spaced apart from one another without foam seams or foam joints that extend along the stems. The pairs of stem mold segments 30 partially define longitudinal mold cavities 32 for the stems 26. The bottoms of the mold cavities 32 are closed by closing members 34 that extend between adjacent pairs of the stem mold segments 30.

The end surfaces of the stem mold segments 30 that face the end blocks also form part of the insulation mold 14 that defines cavities to receive and hold the cement forming the end blocks. The illustrated closing members 34 are rigid members glued or otherwise mechanically fastened to the adjacent stem mold segments 30. The illustrated closing members 34 are plywood sheets. A wall stud (not shown) similar to the wall stud 248 shown in FIG. 10 may be fixed to the bottom side of each closing member 34 for attachment of drywall or other finishing materials, or the closing member 34 can be used directly as an attachment member.

The stem mold segments 30 are integral, homogeneous, one-piece members cut from pre-manufactured blocks of EPS form insulation. The illustrated mold segments 30 are cut from nine-foot long blocks of insulation that have a three foot by two foot rectangular cross section. If the panel 10 to be formed in the mold is less than about nine feet long, then a single stem mold segment 30 can extend the entire longitudinal axis of the mold between the end blocks. If the panel 10 to be formed in the mold is longer than about nine feet long, two or more mold segments 30 can be placed end-to-end along each axis to span the required length of the mold 14 between the end blocks.

The illustrated stems 26 extend away from the deck bottom surface 28 by are about 11 inches and are about two inches thick.

The stem mold segments 30 include like stem mold segments 30*a* that are each placed between adjacent pairs of mold segments and like end stem mold segments 30*b* that are each placed adjacent to a single stem mold segment 30.

Each illustrated stem mold segment 30*a* is about 21 inches wide and about 11 inches deep. The mold segment 30*a* is a generally "U" or "C" shaped member and includes spaced apart legs joined together by a web 38. The legs 36 are each about 5 inches wide. The web 38 is about 3 inches thick.

The outside surfaces of the legs 36 define respective sides of the mold cavities 32 located on either side of the mold segment 30*a*. The upper surface of the web 38 defines the bottom of the deck 16 that spans between the two adjacent mold cavities 32. Having a cutout portion in the stem mold segment 30*a* between the legs 36 to define the interior of the "U" or "C" shape reduces the weight of the stem mold segment 30*a*. The cutout portion also enables more efficient utilization of the foam block supplying the mold segments 30*a* as will be explained in greater detail below.

Each stem mold segment 30*b* is generally rectangular in cross-section and sized to extend between an adjacent stem 26 and a longitudinal side 20 of the deck 16.

Figure 3:
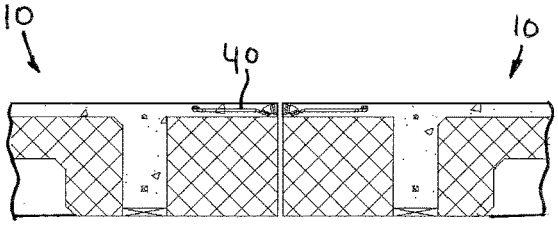
FIG. 3 illustrates two of the precast concrete floors shown in FIG. 1 connected side-by-side.

FIG. 3 illustrates two like floor panels 10 connected side-by-side by metal slab connectors 40. The stem mold segments 30*b* do not extend beyond the deck 16 and enable the floor panels 10 to be spaced closely to one another. The connection of the two floor panels 10 is otherwise conventional and so will not be discussed in further detail.

Figure 4:
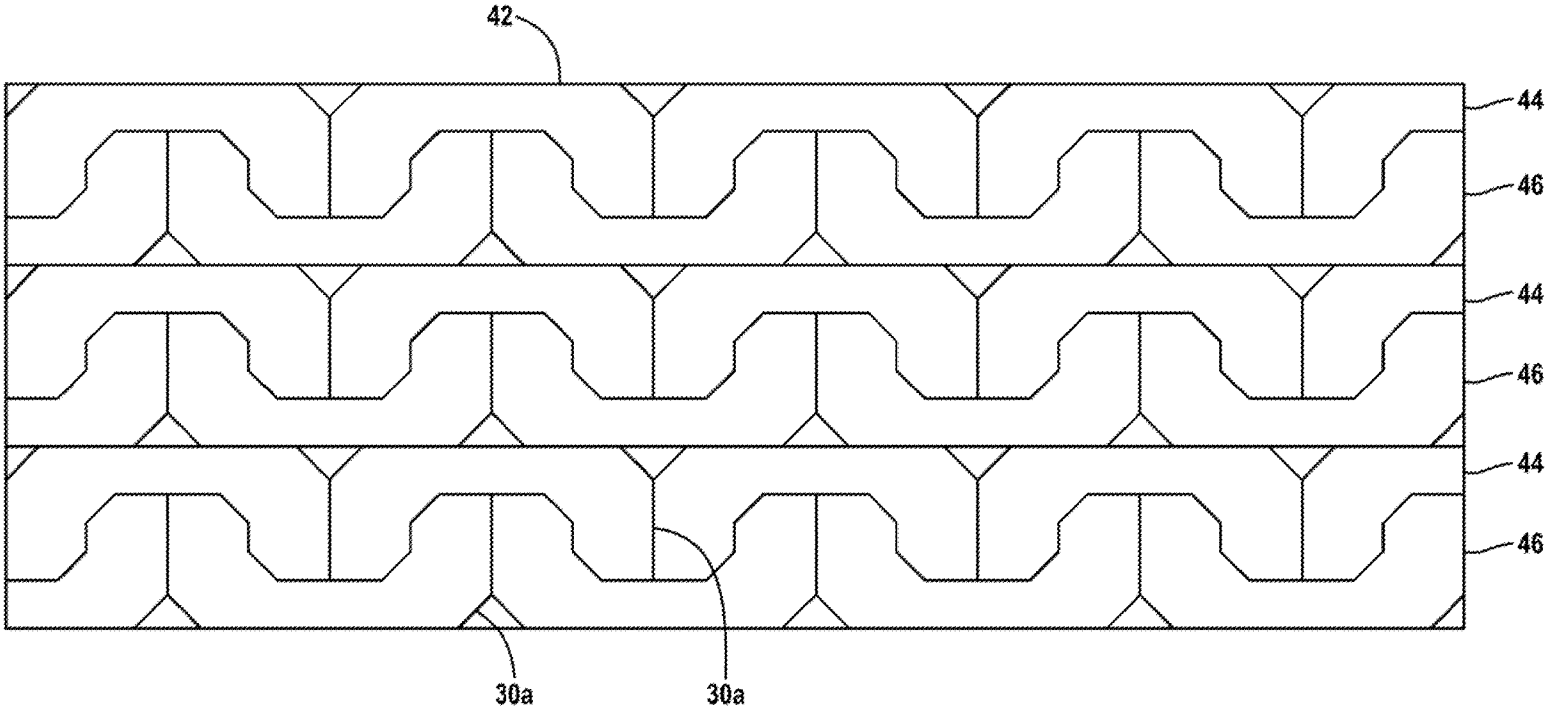
FIG. 4 shows a cutting pattern for cutting the stem mold segments shown in FIG. 2 from a foam block.

FIG. 4 illustrates a periodic tiling pattern used to cut stem mold segments 30*a* from an EPS foam block 42. FIG. 4 illustrates the tiling pattern on a rectangular cross-section of the block 42. Except for stem mold segments 30*a* that adjoin an outer face of the block, all outer surfaces of a stem mold segment 30*a* are surfaces cut from the block 40. The illustrated tiling pattern has two tiling rows 44, 46 of interlocking stem mold segments 30*a* extending across the width of the block 42 and the rows 44, 46 repeating across the height of the block 42. The stem mold segments 30*a* in a row 44 are offset columnwise by one-half the segment width from the pair of facing stem mold segments 30*a* in the adjacent row 46.

The cutout portion removed from a stem mold segment 30*a* between the legs of the "U" in a tiling row 44 or tiling row 46 is used in forming a leg 36 of each facing stem mold segment 30*a* in the other row 46 or row 44. This interlocking pattern enables cutouts to be formed in the stem mold segments 30*a* for weight saving without substantial waste of foam insulation. In embodiments portions of the block 42 not used in the stem mold segments 30*a* can be used to form stem mold segments 30*b* or other parts of the mold 14 to further eliminate waste.

Figure 5:
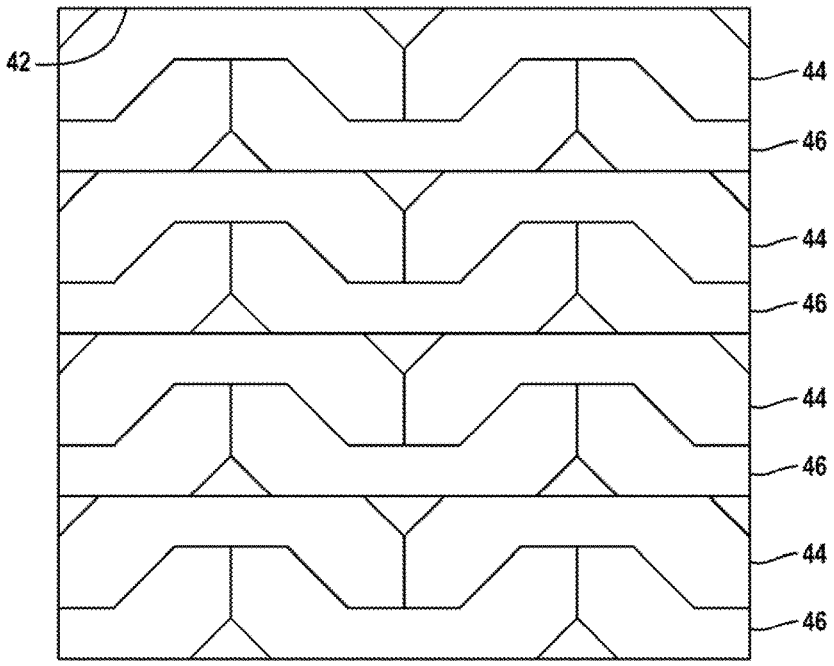
FIGS. 5 and 6 illustrate cutting patterns for cutting other embodiments of stem mold segments.
Figure 6:
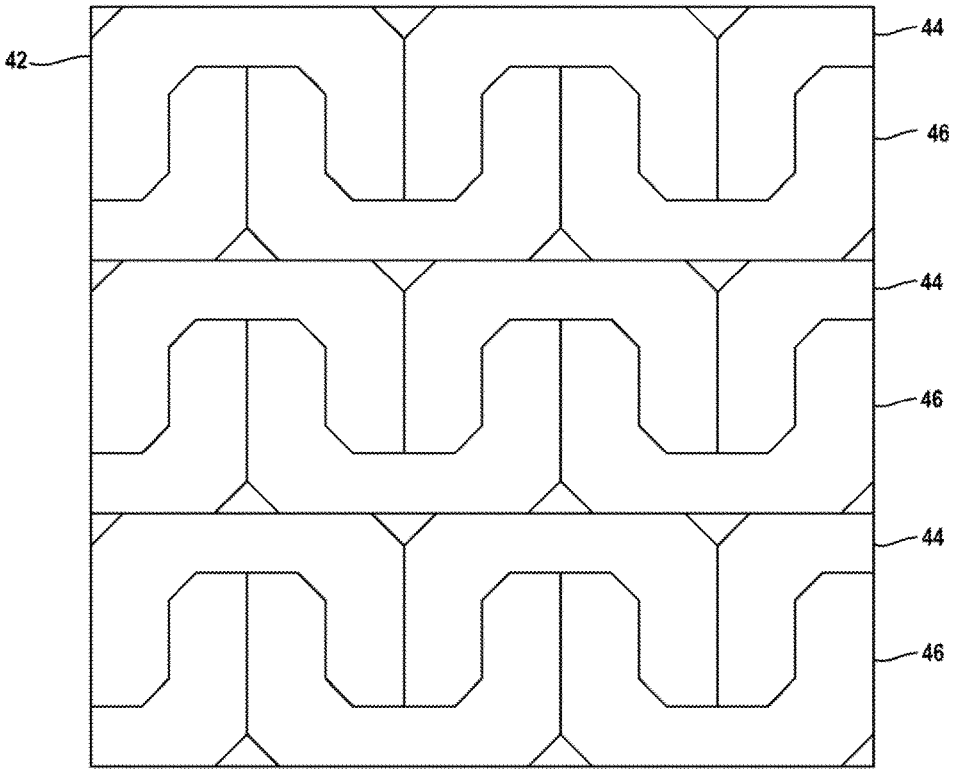

FIGS. 5 and 6 illustrate similar tiling patterns for cutting other embodiments of stem mold segments 30*a* from an EPS foam block 42 using interlocking tiling rows 44, 46.

Figure 7:
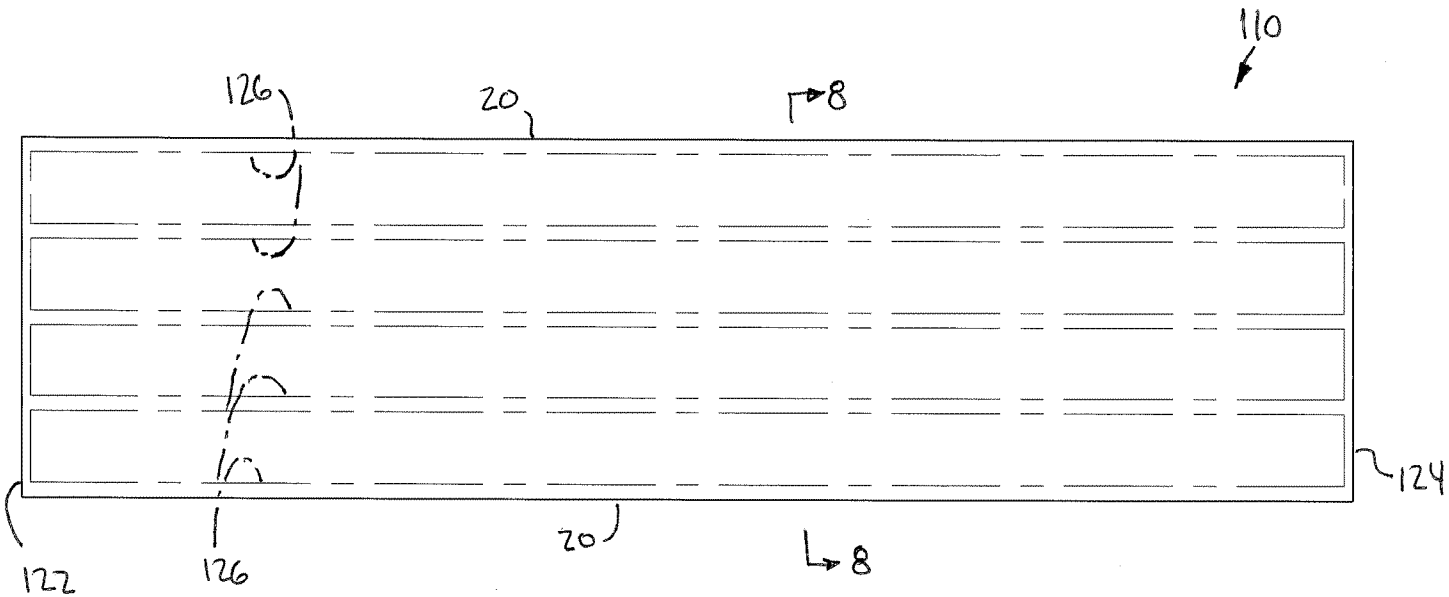
FIG. 7 is a plan view of the top of a precast concrete floor without a deck and intended to be manufactured off-site but completed on-site.
Figure 8:
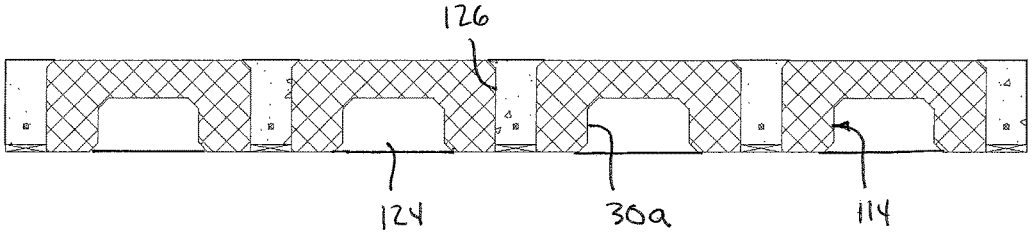
FIG. 8 is a cross-sectional view of the floor shown in FIG. 7 taken along line 8-8 of FIG. 7.

FIGS. 7 and 8 illustrate a pre-cast, concrete floor panel or slab 110 that was poured and cured in a mold formed in part from the mold segments 30*a* previously described. The mold segments 30*a* remain attached to the cured concrete.

The floor panel 110 is formed with end blocks 122 and 124 like the end blocks 22, 24 and stems 126 like the stems 26. In the illustrated embodiment the outer stems 126 are placed on the longitudinal sides 20 of the floor panel 110. This enables all the stem mold segments to be mold segments 30*a* as can be best seen in FIG. 8.

The slab or floor panel 110 is initially constructed without the equivalent top sheet or deck 16 of the floor panel 10. The deck is intended to be constructed off-site, that is, the cement for the deck is poured and cured later after the floor panel 110 shown in FIGS. 7 and 8 is completed. The mold 114 includes the mold segments 30*a* that remain attached to the end blocks 122, 124 and the stems 126 and partially define the later formed deck.

It has been found that having the end blocks 122, 124 and the stems 126 form a unitary structure provides sufficient rigidity and strength for transportation of the floor panel 110 to a job site. By not forming the deck, the weight of the floor panel 110 is significantly reduced and a truck can transport more of the more of the partially completed floor panels to the job site.

A temporary mold form made of plywood or timber that defines the outer perimeter of the deck is formed on-site for pouring the deck.

Figure 9:
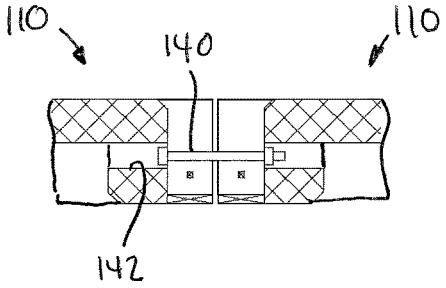
FIG. 9 illustrates two of the precast concrete floors shown in FIG. 7 connected side-by-side.

FIG. 9 illustrates two floor panels 110 bolted together side-by-side by a set of bolt fastener assemblies 140. Clearance holes 142 are formed in the facing mold segments 30*a* for the bolts and nuts, the bolt extending through bolt holes in the facing stems 126.

The floor panel 110 has a pair of outermost stems 126 that are not sandwiched between adjacent pairs of stems and are located along the left and right sides respectively of the panel 110 as viewed in FIG. 8.

Figure 10:
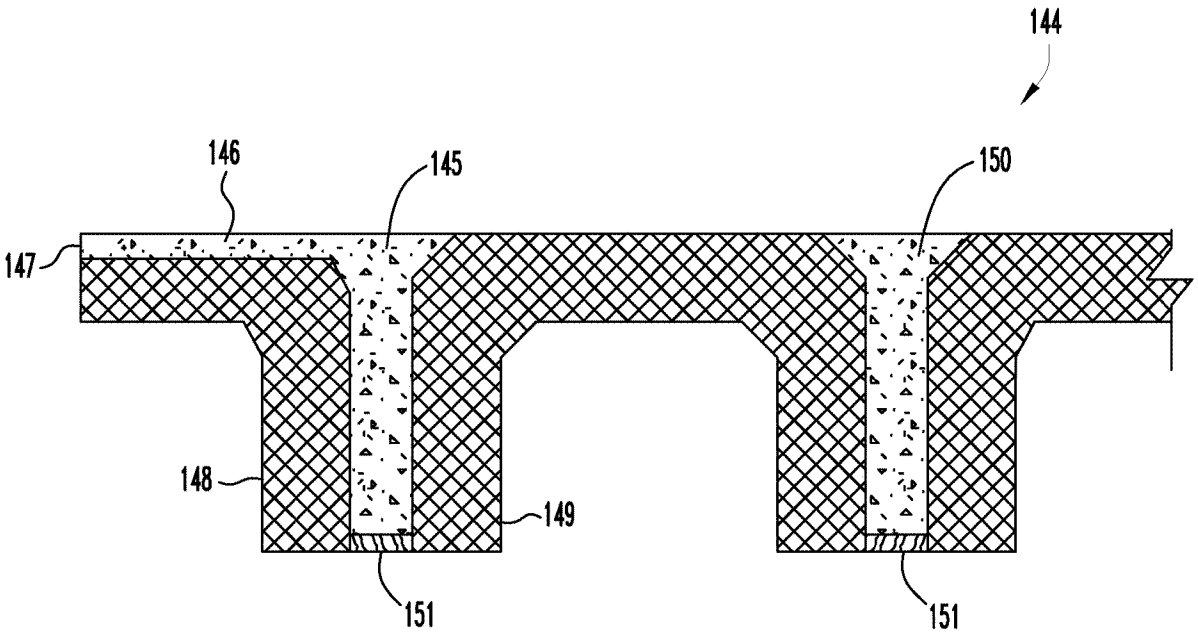
FIG. 10 is a cross-sectional view similar to FIG. 8 of a portion of an alternative embodiment precast concrete floor without a deck and intended to be manufactured off-site but completed on-site.

FIG. 10 illustrates a left side portion of a slab 144 in which the left-most stem 145 is spaced away from the longitudinal left edge of the slab 144. To provide greater structural support of the slab 144 along the longitudinal edge of the slab 144, the stem 145 includes a relatively thin support flange 146 that is even with and extends from the top of the stem 145 to an outer, flat flange surface 147. The flange surface 147 is flush with and extends along the longitudinal left edge of the slab 144. The flange surface 147 is also flush with an outer facing surface of a stem mold segment 148. The stem mold segment 148 cooperates with a stem mold segment 149 (stem mold segment 149 is like a stem mold segment 30*a*) in defining a mold cavity for the stem 145 and its flange 146. Interior stems 150 that are located between adjacent pairs of stems are formed using adjacent pairs of stem mold segments 149 as described above for the floor 110. The right-most stem (not shown) is a mirror image of the stem 145 and includes a flange like the flange 146 that extends along the right longitudinal edge of the slab 144. Lumber pieces 151 between adjacent mold segments close the mold between mold segments.

The support flange 146 helps support the deck that is poured on top of the slab 144 as previously described for the slab 110.

Figure 11:
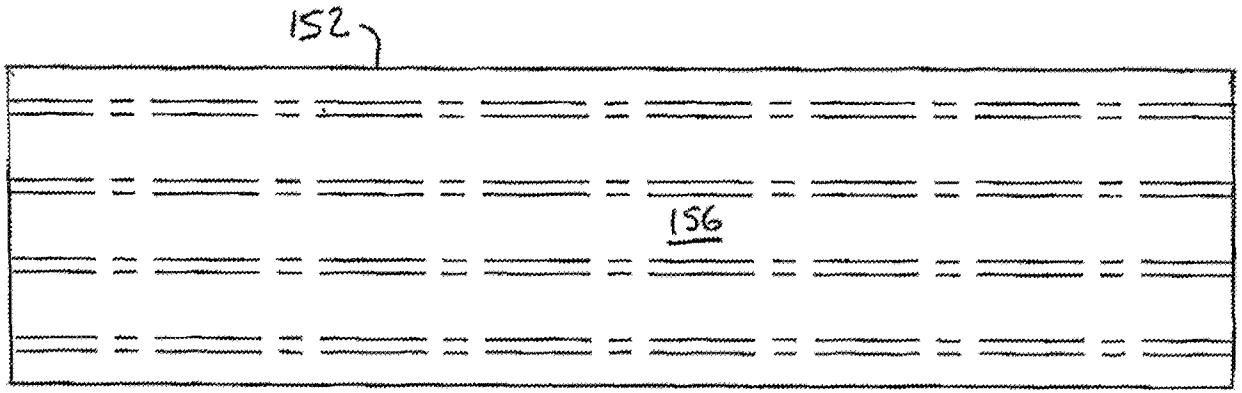
FIGS. 11 and 12 are top and end views respectively view of a precast concrete floor with a relatively thicker flange and without end blocks.
Figure 12:
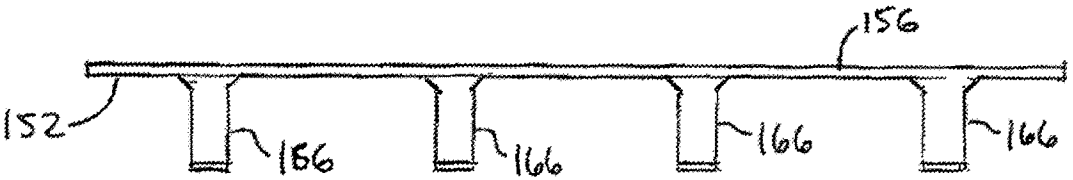

FIGS. 11 and 12 show views of a precast concrete floor formed as a monolithic concrete slab 152 that was poured and cured in a mold constructed entirely from, in the illustrated embodiment, one-quarter inch steel plate. There is no insulation attached to the concrete slab 152 when the slab 152 is removed from the mold after solidifying. Insulation can be attached to the concrete slab 152 after removal from the mold if desired.

The slab 152 has a top flange or deck 156 that includes the top surface of the floor. The deck 156 is similar to the deck 16 but is relatively thicker than the deck 16. By thickening the deck 156, it is possible to cast the slab 152 within a steel form or mold without the need for EPS foam forming any part of the mold and without the need for end blocks molded into the slab to support the stems 166. The slab 152 is removed from the mold and is moved during transport using conventional vacuum lifting devices or lifting brackets typically used for lifting steel plate. Vacuum lifters that can be modified for use in lifting and moving the slab 152 are available from, among others, The Caldwell Group, Inc., Rockford, Ill., USA.

Figure 13:
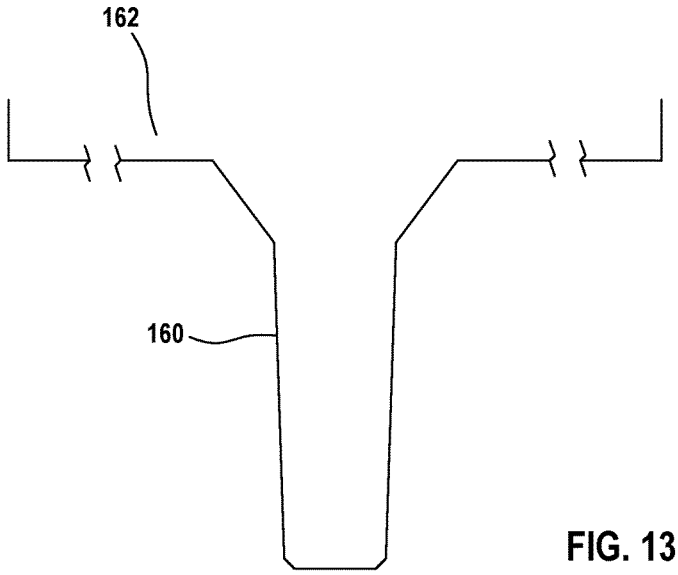
FIG. 13 is an end view of a portion of a form for casting the precast floor shown in FIG. 11.
Figure 14:
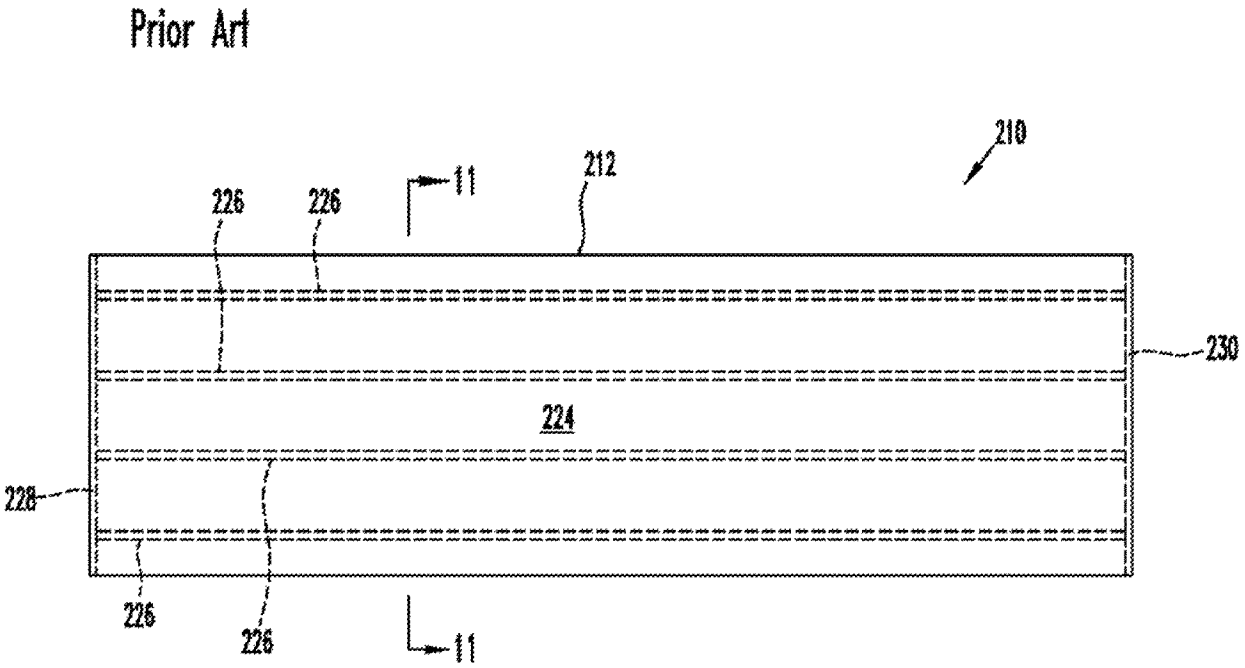
FIGS. 14-16 illustrate a top plan view, cross-sectional view, and an enlarged view of a portion of a prior art precast concrete floor.
Figure 15:
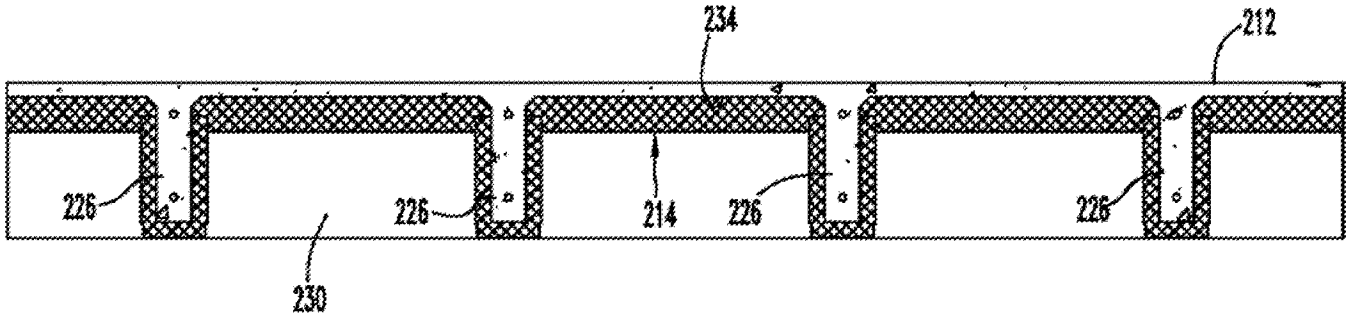
Prior Art FIG. 15
Figure 16:
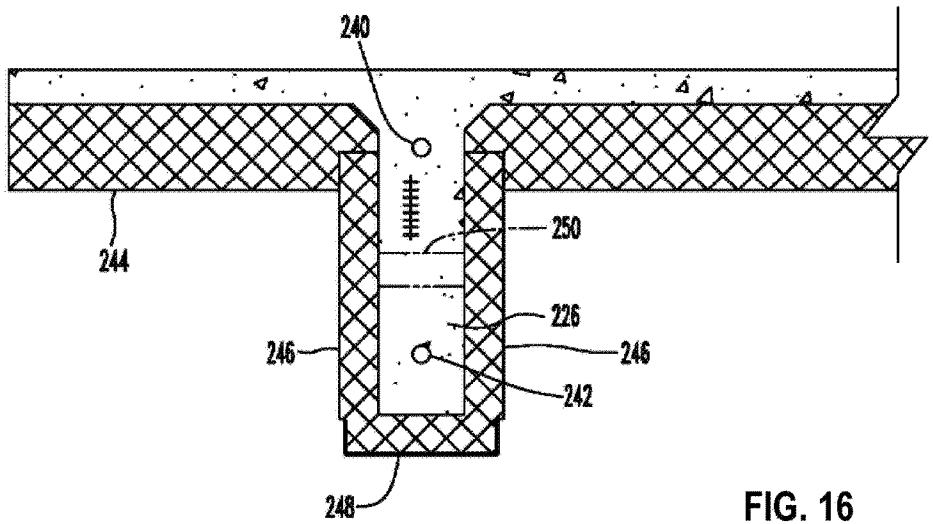

The form used for casting the slab 153 may be a reusable form perhaps several hundred feet long for use at a precast plant. The form is, in an embodiment, made from steel plate that is bent as needed to form the desired shape. FIG. 13 illustrates a steel plate bent to form a portion of the mold defining a stem cavity 160 for forming a stem and a deck cavity 162 for forming the deck, the deck cavity opening to each of the stem cavities. The outer stem cavities can define a stem like the stem 145 if the outer stems are spaced from the outer longitudinal edges of the floor slab. In the illustrated embodiment the floor slab is made without end blocks and so the mold defines only stem cavities and a deck cavity.

The mold is used to cast multiple slabs 152 at the same time (in a possible embodiment it is contemplated that ten slabs 152 are formed simultaneously). The slabs 152 would be formed end-to-end along the length of the form, with each slab 152 separated from an adjacent slab by a removable bulkhead placed in the form. The bulkhead is placed along the form as required by the desired length of the slab, enabling slabs of varying length to be formed merely by changing the location of the bulkheads. If desired, members or studs can be placed in the form for attachment to the bottom of the stems.

While one or more embodiments have been disclosed and described in detail, it is understood that this is capable of modification and that the scope of the disclosure is not limited to the precise details set forth but includes modifications obvious to a person of ordinary skill in possession of this disclosure and also such changes and alterations as fall within the purview of the following claims.

What is claimed is:

1. A method for forming at least a portion of a precast insulated concrete floor panel having a deck and a plurality of spaced-apart stems extending along the length of the floor panel from the deck, the method comprising the steps of:

cutting a plurality of stem mold segments from a larger block of expanded polystyrene foam insulation, the multiple stem mold segments being cut from the same block of foam insulation, the stem mold segments being cut in an interlocking pattern from the block of foam insulation, each stem mold segment having a generally "U" shaped cross section having a pair of spaced-apart legs and a web between the legs, the interlocking pattern being formed by the legs of two stem mold segments being cut from between the legs of a third stem mold segment;

providing a mold, the mold comprising the plurality of elongate stem mold segments extending parallel with one another on respective longitudinal axes in a length direction and being spaced apart laterally adjacent one another in a width direction perpendicular to the length direction, each pair of adjacent stem mold segments having outer surfaces adjacent to one another that define a space therebetween having the shape of the stem to be formed between the pair of adjacent stem mold segments, each mold segment being an integral one-piece foam insulation member formed without seams or joints that extend in the length direction; and pouring concrete into the spaces between the stem mold segments.

2. The method of claim 1 wherein each pair of adjacent mold segments are connected together by a rigid member closing a side of the space defined by the adjacent stem mold segments.

3. The method of claim 1 wherein a top end of the each space between adjacent pairs of stem mold segments receives the cement poured into the space, the method further comprising the steps of:

pouring the concrete to the top end of each space and not above the top end; and allowing the concrete in the spaces to harden to form rigid stems without pouring additional concrete in the spaces, thereby forming a partially completed floor panel without a deck.

4. The method of claim 3 comprising the steps of:

transporting the partially completed floor panel from a first location to a second location; and pouring concrete for a deck on the partially completed floor panel at the second location.

5. The method of claim 1 wherein the mold defines a pair of cavities for forming end blocks, the plurality of stem mold segments comprise a respective set of adjacent pairs of stem mold segments associated with each cavity that face each cavity with the spaces between the adjacent pairs of stem mold segments opening into each cavity.

6. The method of claim 1 comprising the step of continuously pouring concrete into the spaces between the stem mold segments to form the stems of the floor panel and pouring concrete over the stem mold segments to form the deck of the floor panel.

7. The method of claim 1 wherein more than one stem mold segment extends on each longitudinal axis.

* * * * *